US009415603B2

(12) United States Patent
Murayama et al.

(10) Patent No.: US 9,415,603 B2
(45) Date of Patent: Aug. 16, 2016

(54) IMAGE PROCESSING METHOD AND IMAGE PROCESSING APPARATUS

(71) Applicant: CANON KABUSHIKI KAISHA, Tokyo (JP)

(72) Inventors: Yoshiaki Murayama, Tokyo (JP); Minoru Teshigawara, Saitama (JP); Satoshi Azuma, Kawasaki (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/281,589

(22) Filed: May 19, 2014

(65) Prior Publication Data

US 2014/0347417 A1 Nov. 27, 2014

(30) Foreign Application Priority Data

May 21, 2013 (JP) ..... 2013-107471
Apr. 1, 2014 (JP) ..... 2014-075827

(51) Int. Cl.
*B41J 29/38* (2006.01)
*B41J 2/21* (2006.01)

(52) U.S. Cl.
CPC ..... *B41J 2/2146* (2013.01); *B41J 2/2142* (2013.01)

(58) Field of Classification Search
CPC ..... B41J 2/2146
USPC ..... 347/5, 9, 14, 19, 12, 15
See application file for complete search history.

(56) References Cited

U.S. PATENT DOCUMENTS

2004/0104951 A1* 6/2004 Shibata et al. ..... 347/14
2010/0149567 A1* 6/2010 Kanazawa et al. ..... 358/1.9
2010/0309488 A1* 12/2010 Koyama et al. ..... 356/908

FOREIGN PATENT DOCUMENTS

JP 2006-198793 A 8/2006
JP 2009-006560 A 1/2009

* cited by examiner

*Primary Examiner* — Lam Nguyen
(74) *Attorney, Agent, or Firm* — Canon USA, Inc. I.P. Division

(57) ABSTRACT

Multiple test pattern printing using each of multiple printing element arrays are read, and in a case where a streak is present in predetermined test patterns of the multiple test patterns at the same position in the direction of the array of the printing elements, determination is made that the streak is not due to failure of a printing element.

13 Claims, 16 Drawing Sheets

IMAGE PROCESSING METHOD AND IMAGE PROCESSING APPARATUS

BACKGROUND

1. Field of the Disclosure

Aspects of the present invention generally relate to an image processing method and an image processing apparatus to print images on a printing medium.

2. Description of the Related Art

There has conventionally been known a technique to detect defective printing elements, by printing a pattern for detecting defective printing elements between printing of images and reading the pattern using a reading unit. On the other hand, if a small scratch on the printing medium, foreign matter, or the like, is included in this pattern, the image defect at that portion may be erroneously recognized as being due to a printing element failure, and the printing element may be determined to have failed even though a printing element failure has not actually occurred. Japanese Patent Laid-Open No. 2006-198793 describes preventing erroneously detecting scratches on the printing medium and so forth as being printing trouble due to a failure of the printing element, by making the pattern for detecting failure of the printing element sufficiently longer than a scratch which might be formed.

On the other hand, there are conceivably cases where foreign matter which has got into the conveyance path of the printing medium, or a protrusion created on a conveying member, coming into contact with the printing medium being conveyed, thereby consecutively scratching the printing medium and causing long streaks in the printed image. In such a case, making the pattern for detecting failure of the printing element longer, as described in Japanese Patent Laid-Open No. 2006-198793, may result in an erroneous determination that the consecutive streak formed on the printing image due to the scratch is due to failure of the printing element. Similarly, foreign matter of the like adhering to a scanning region of a sensor of a scanner or the like which scans and reads the test pattern may erroneously determine that there is a consecutive streak at the corresponding region, and that this is due to failure of the printing element corresponding to the position of the streak. Once erroneous determination is made that the printing element has failed, complementation printing processing is performed so that the printing element, which has not failed but has been erroneously determined to have failed, is not used. This unnecessary complementation printing results in an inferior image.

SUMMARY

Aspects of the present invention provides an image processing method and image processing apparatus capable of printing high-quality images by distinguishing between streaks due to printing element failure and streaks due to trouble other than printing element failure.

An image processing method is provided to print an image on a printing medium transported in a second direction, using a printing head on which a plurality of printing element arrays, each including a plurality of printing elements arrayed in a first direction perpendicular to the second direction, are arrayed in the second direction. The method comprising includes an obtaining step to obtain information regarding a position where color difference in the first direction has occurred in each of a plurality of test patterns printed on the printing medium or on a conveyance unit which transports the printing medium using each array of the plurality of printing element arrays, and a determining step to determine a printing element which has printed a position corresponding to the obtained information to have not failed in printing, in a case where the obtained information indicates that color difference has occurred at a same position in the first direction within predetermined test patterns of a plurality of test patterns.

Further features of the present invention will become apparent from the following description of exemplary embodiments with reference to the attached drawings.

DESCRIPTION OF THE EMBODIMENTS

First Embodiment

Description of Apparatus Configuration

An embodiment will be described, using an ink-jet printing apparatus which prints images using a printing head having a plurality of nozzle arrays on which nozzles are arrayed, as an example of a printing apparatus. The plurality of nozzle arrays is printing element arrays. The ink-jet printing apparatus according to the present embodiment uses a rolled continuous sheet as a printing medium. The ink-jet printing apparatus according to the present embodiment is a high-speed line printer which can perform both single-side and double-side printing.

Figure 1:
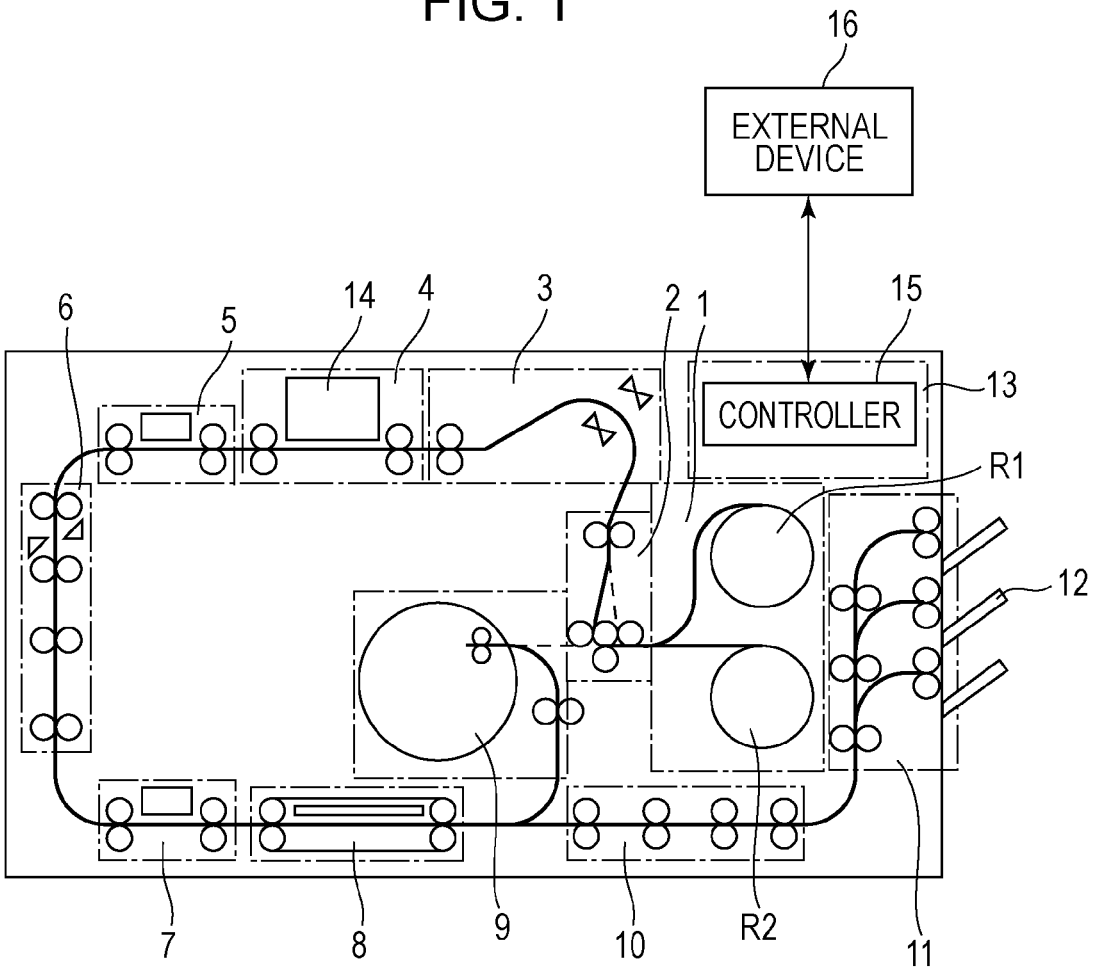
FIG. 1 is a schematic cross-sectional view illustrating the internal configuration of an ink-jet printing apparatus.

FIG. 1 is a schematic cross-sectional view illustrating the internal configuration of an ink-jet printing apparatus. The ink-jet printing apparatus according to the present embodiment includes therein a sheet supply part 1, a curl reforming unit 2, a skew rectification unit 3, a printing unit 4, an inspecting unit, 5 a cutter unit 6, an information printing unit 7, a drying unit 8, a sheet windup unit 9, a discharge conveyance unit 10, a sorter unit 11, ejecting trays 12, and a control unit 13. The sheet is conveyed by a conveyance mechanism made up of roller pairs and belts following a sheet conveyance path indicated by solid lines in FIG. 1, and subjected to processing by the units while being conveyed. The units have rollers and the like for conveying the sheet.

Figure 4A:
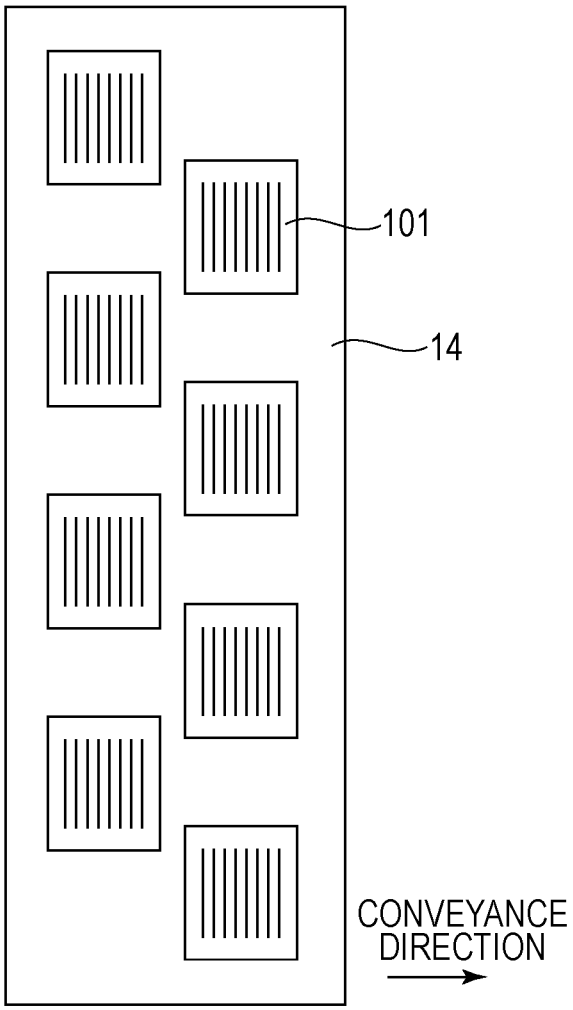
FIGS. 4A and 4B are diagrams illustrating a discharge port face of a printing head.

The sheet supply part 1 stores and supplies a rolled continuous sheet. The sheet supply part 1 according to the present embodiment can store two rolls R1 and R2, and can unroll a sheet off of either roll. The curl reforming unit 2 lessens curling of the sheet supplied from the sheet supply part 1. The curl reforming unit 2 acts to lessen curling of the sheet by curving and squeezing the sheet using two pinch rollers as to one driving roller, to curve the sheet in the opposite direction of the curling. The skew rectification unit 3 rectifies skewing (misalignment of the direction of the sheet as to the direction in which the sheet should travel) which has passed through the curl reforming unit 2. A side of the sheet serving as a reference is pressed against a guide member, thereby rectifying skewing of the sheet. The printing unit 4 prints images on sheets using a printing head 14. The printing head 14 according to the present embodiment is a line head where nozzle arrays capable of printing an image are arrayed over the greatest sheet width of which usage is anticipated. The printing head 14 includes multiple discharge substrates 101 and 102, as illustrated in FIG. 4A which will be described later. Each discharge substrate has nozzle arrays arrayed in the sheet conveyance direction. The ink-jet printing apparatus according to the present embodiment includes a print head for each of the four colors of ink which are black (Bk), cyan (C), magenta (M), and yellow (Y). These printing heads are arrayed in the order of a printing head corresponding to Bk, a printing head corresponding to C, a printing head corresponding to M, and printing head corresponding to Y, in that order from the upstream side toward the downstream side in the conveyance direction. Ink of each color is supplied to the printing head 14 from an ink tank through an ink tube.

The inspecting unit 5 optically prints an inspection pattern printed on the sheet by the printing unit 4, so as to inspect the state of the nozzles of the printing head 14, the state of sheet conveyance, image position, and so forth. A charge-coupled device (CCD) line sensor is used as the inspecting unit 5 in the present embodiment, with the CCD line sensor being arrayed in a direction perpendicular to the sheet conveyance direction. Separately, an central processing unit (CPU) (not illustrated) for analyzing is provided, as an analyzing unit 17. The cutter unit 6 cuts the sheet on which images have been printed into sheets of a predetermined length. The information printing unit 7 prints printing information, such as serial No. and date, on the rear face of the cut sheets. The drying unit 8 heats the sheets printed at the printing unit 4, so as to dry the ink on the sheets in a short time. The sheet windup unit 9 is used when performing double-side printing, and has a windup drum to rotate and temporarily wind up a continuous sheet regarding which printing on the front face has been completed. Once the sheet has been wound onto the sheet windup unit 9, the windup drum is rotated in reverse, the sheet wound thereupon is supplied to the curl reforming unit 2, and then to the printing unit 4 again. The front and rear faces of the sheet have been reversed in this process, so the printing unit 4 can print images on the rear face of the sheet. Single-side printing and double-side printing will be described later in detail.

The discharge conveyance unit 10 conveys sheets dried at the drying unit 8 to the sorter unit 11. The sorter unit 11 sorts and ejects the cut sheets to the ejecting trays 12 in groups.

The control unit 13 controls the overall printing apparatus according to the present embodiment. The control unit 13 includes a controller 15 which has a CPU, memory, and various types of input/output (I/O) interfaces. The control unit 13 also includes a power source. Operations of the printing apparatus are controlled based on instructions from a controller 15, or an external apparatus 16 such as a host computer or the like, connected to the controller 15 by way of an I/O interface.

Figure 2A:
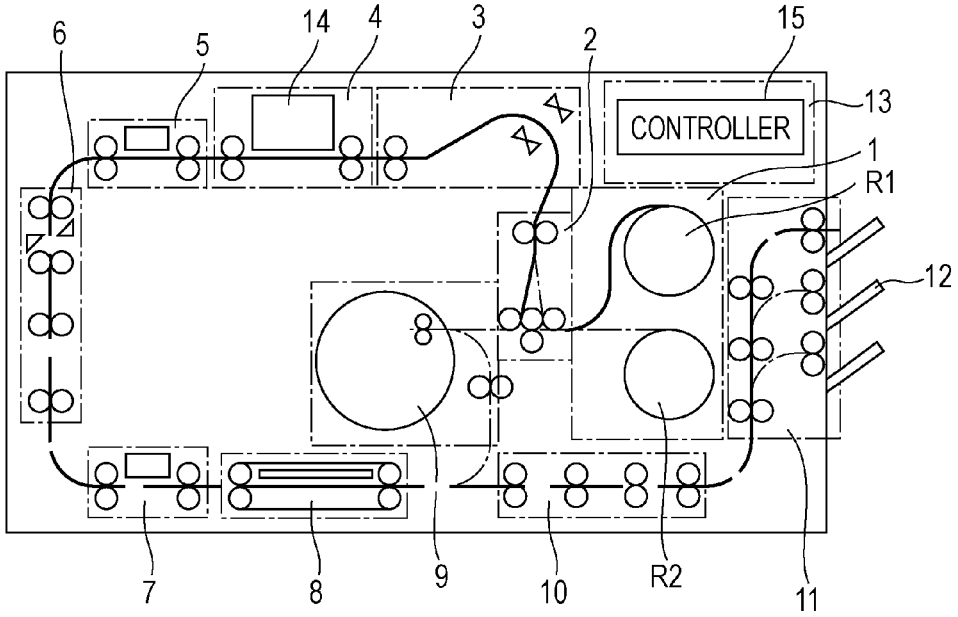
FIGS. 2A and 2B are diagrams for describing operations of single-side printing and double-side printing.
Figure 2B:
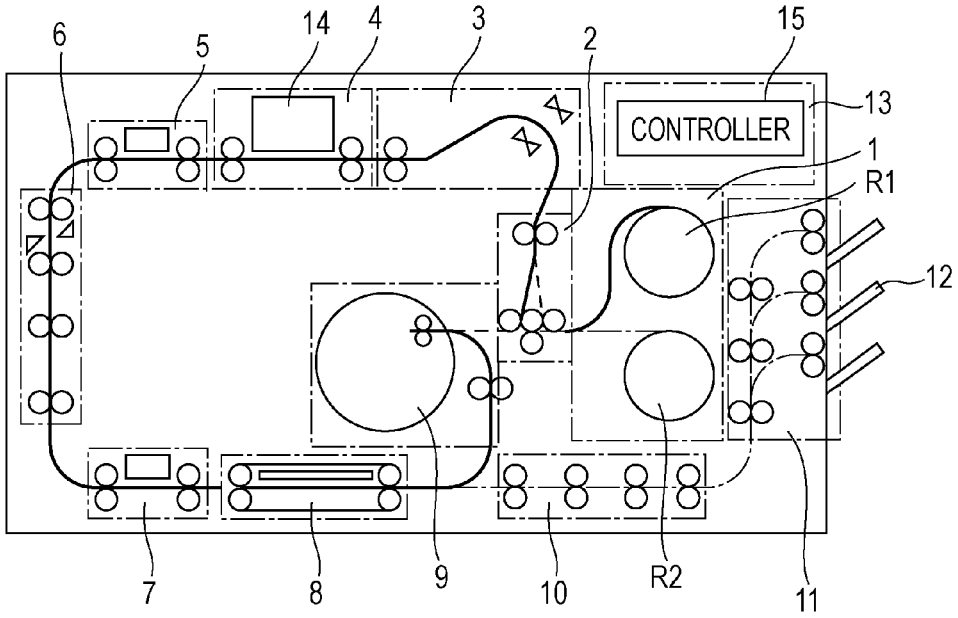

Next, single-side printing and double-side printing using the ink-jet printing apparatus according to the present embodiment will be described with reference to FIGS. 2A and 2B. FIG. 2A is a diagram illustrating the conveyance path of the sheet when performing single-side printing, and FIG. 2B is a diagram illustrating the conveyance path of the sheet when performing double-side printing. In either drawing, the conveyance path over which the sheet is supplied from the sheet supply part 1, printed with images, and ejected at the ejecting trays 12, is indicated by heavy lines.

In a case of performing single-side printing, the sheet is supplied from the sheet supply part 1, and processing is performed at each of the curl reforming unit 2 and skew rectification unit 3, as illustrated in FIG. 2A. Images are printed on the front face of the sheet at the printing unit 4. The sheet upon which images have been printed is inspected at the inspecting unit 5 and cut into sheets of predetermined length at the cutter unit 6. The cut sheets are printed on the rear face at the information printing unit 7 with printing information, conveyed to the drying unit 8 one sheet at a time where the ink is dried, and then conveyed to the ejecting trays 12 of the sorter unit 11.

In a case of performing double-side printing, as illustrated in FIG. 2B, cut processing is not performed at the cutter unit 6 immediately after having printed images on the front face of the sheet. The sheet is conveyed to the drying unit 8 as a continuous sheet with images printed on the front face, and the ink is dried. The sheet is then conveyed from the drying unit 8 to the sheet windup unit 9. The conveyed sheet is wound onto the winding drum of the sheet windup unit 9. After all planned printing of the front face of the sheet at the printing unit 4 is completed, the trailing end of the sheet is cut by the cutter unit 6. The portion of the sheet further downstream from the cut is completely wound back to the winding drum. The portion of the sheet further upstream from the cut is wound back to the sheet supply part 1 so that the leading end of the sheet is not remaining at the curl reforming unit 2. The sheet wound onto the winding drum is then conveyed to the curl reforming unit 2 over the path indicated by the heavy line in FIG. 2B, such that the trailing end at the time of winding onto the winding drum is not the leading end for the following rear face printing. The sheet is subjected to processing by the skew rectification unit 3, and images are printed on the rear face by the printing unit 4. The printed sheet is inspected at the inspecting unit 5, and then cut into sheets of predetermined length at the cutter unit 6. Images are printed on both sides of the sheet when performing double-side printing, so printing of printing information by the information printing unit 7 is not performed in the present embodiment. The cut sheets are conveyed to the drying unit 8 one sheet at a time and dried, and then ejected to the ejecting trays 12 of the sorter unit 11 via the discharge conveyance unit 10.

Description of Control Configuration

Figure 3:
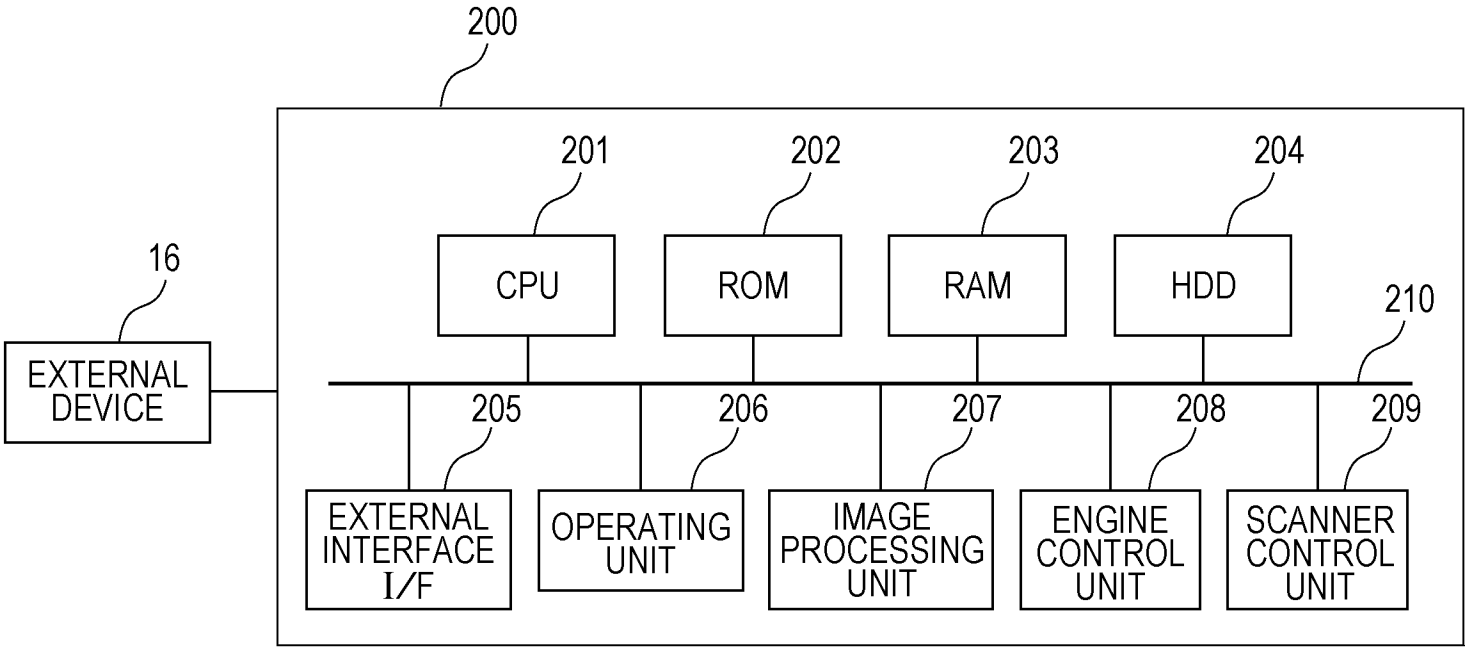
FIG. 3 is a diagram for describing a control configuration.

FIG. 3 is a block diagram for describing the control configuration of the printing apparatus illustrated in FIG. 1. In FIG. 3, the printing apparatus 200 is the ink-jet printing apparatus illustrated in FIG. 1. The aforementioned control unit 13 includes a CPU 201, read-only memory (ROM) 202, random access memory (RAM) 203, an image processing unit 207, an engine control unit 208, and a scanner control unit 209. Connected to the control unit 13 are a hard disk drive (HDD) 204, operating unit 206, external interface 205, and so forth, via a system bus 210.

The CPU 201, which is a microprocessor, controls the overall operations of the printing apparatus 200 by executing programs and delivering instructions to various hardware components. The ROM 202 stores programs to be executed by the CPU 201, and fixed data necessary for various operations of the printing apparatus 200. The RAM 203 is used as a work area for the CPU 201, a temporary storage region for various types of received data, a storage region for various types of setting data, and so forth. The HDD 204 can store programs to be executed by the CPU 201, printing data, and setting information necessary for the operations of the printing apparatus 200, in a built-in hard disk, and read out the same. Note that some other large-capacity storage device may be used instead of the HDD 204.

The operating unit 206 includes hard keys or a touch panel for users to make various types of operations, and a display unit to present (notify) various types of information to the user, and corresponds to the external apparatus 16 illustrated in FIG. 1. Presenting of information to the user may be performed by outputting acoustics (buzzer, audio, etc.) based on acoustic information from an audio generator. The image processing unit 207 rasterizes printing data (e.g., data in a page description language) for the printing apparatus 200 to handle, into image data (bitmap image), and performs image processing. For example, processing is performed such that the color space of the image data included in the input printing data (e.g., YCbCr) is converted into a standard RGB color space (e.g., sRGB). Also, the image data may be subjected to various types of image processing, such as resolution conversion to a pixel count which the printing apparatus 200 is capable of handling to perform printing, image analysis, image correction, and so forth. The image data obtained from this image processing is stored in the RAM 203 or the HDD 204.

The engine control unit 208 controls the processing of printing images on the sheet based on printing data, in accordance with control commands received from the CPU 201 or the like. Specific examples include instructions to discharge ink that are given to the printing heads 14 for each of the ink colors, setting discharge timing so as to adjust the dot positions (ink landing positions) on the printing medium, adjustments based on acquired head driving state information, and so forth. The engine control unit 208 performs driving control of the printing head based on printing data, so that the printing heads discharge ink and form images on the sheet. The engine control unit 208 also gives feed roller driving instructions and conveying roller driving instructions, acquires rotation state information of conveying rollers, and so forth, and controls the conveying rollers so that the sheet is conveyed at an appropriate speed over a correct path, and stopped correctly.

The scanner control unit 209 reads images on the sheet by controlling the CCD sensor of the inspecting unit 5 accordance with control commands received from the CPU 201 or the like. The scanner control unit 209 then converts analog luminance data of red (R), green (G), and blue (B) colors obtained by the CCD sensor, into digital data. While the present embodiment uses a CCD sensor as an image sensor, a CMOS image sensor or the like may be used instead. Also, a linear image sensor or an area image sensor may be used as the image sensor. The scanner control unit 209 also gives driving instructions to the image sensor, and acquires state information of the image sensor based on this driving. The scanner control unit 209 then analyzes the luminance data obtained from the image sensor, and performs detection of ink defective discharge from the printing head 14, detection of the cutting position of the sheet, and so forth. Sheets regarding which the scanner control unit 209 determines that the image has been correctly printed are subjected to drying processing of the ink thereupon, and ejected to a specified ejecting tray 12.

A host device, which is the external apparatus 16, is externally connected to the printing apparatus 200 and is a device which is a supply source of image data to cause the printing apparatus 200 to perform printing. The external apparatus 16 issues orders for various print jobs. The external apparatus 16 may be realized by a general purpose personal computer (PC), or may be an image capturing device which captures images and generates image data. Examples of image capture devices include readers (scanners) which read images on an original document and generate image data, film scanners which read negative film or positive film and generate image data, and so forth. The image capture device may be a digital camera which shoots still images and generates digital image data, or may be a digital video camera which shoots moving images and generates moving image data. Arrangements may be made such as providing a photo storage on a network, or providing a socket for inserting detachable portable memory, so that image files stored in the photo storage or portable memory can be read out, image data generated, and printed.

These data supply devices may be included within the printing apparatus 200, or may be provided as external devices connected to the printing apparatus 200. In a case where the external apparatus 16 is a PC, an operating system (OS), application software to generate image data, and a printer driver for the printing apparatus 200, are installed in a storage device of the PC. A printer driver controls the printing apparatus 200 to generate print data by converting the image data supplied from the application software into a format which the printing apparatus 200 can handle. Also, an arrangement may be where the external apparatus 16 converts the print data into image data, and then supplies this to the printing apparatus 200. Image data supplied from the external apparatus 16, and other commands, status signals, and so forth, can be exchanged with the printing apparatus 200 via the external interface 205. The external interface 205 may either be a local interface or a network interface. While an exemplary description has been made above where one CPU 201 controls all constituent elements within the printing apparatus 200 illustrated in FIG. 3, an arrangement may be made where several of the function blocks have separate CPUs, and control is effected by the respective CPUs.

Description of Printing Head

Figure 4B:
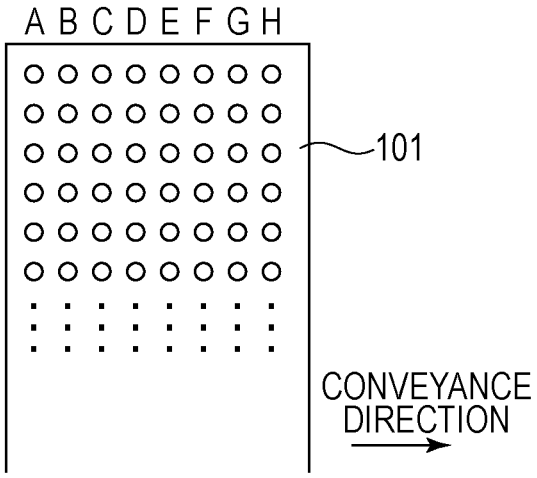

Next, the printing unit 4 according to the present embodiment will be described with reference to FIGS. 4A and 4B. The printing unit 4 is configured including four printing heads corresponding to the four colors of black (Bk), cyan (C), magenta (M), and yellow (Y). The printing head 14 illustrated in FIG. 4A corresponds to ink of one color, and multiple discharge substrates 101 each having an effective discharge width of approximately one inch are arrayed as illustrated in FIG. 4A. The discharge substrates 101 are arrayed so as to overlap in the nozzle array direction (predetermined direction) by a width equivalent to a predetermined number of nozzles. FIG. 4B illustrates a discharge substrate 101, where eight nozzle arrays of nozzle array A through nozzle array H are arrayed in the conveyance direction. Nozzles in the nozzle array A through nozzle array H at corresponding positions in the array direction can print on the same position in the printing medium in the conveyance direction. The nozzles according to the present embodiment are ink-jet nozzles which have heating elements (electrothermal conversion element or heater) to which electricity is applied to generate heat, which in turn causes the ink to bubble, and ink is discharged from discharge ports by this kinetic energy. The direction of conveyance in FIGS. 4A and 4B is the horizontal direction. The printing head 14 has an effective discharge width of approximately 13 inches (a length somewhat exceeding the width of the short side of an A3 size sheet), so one-pass printing can be performed by on A3 sheets by conveying the sheets in the direction of the long side. The printing unit 4 has four printing heads 14, one for each color, which are arrayed in the conveyance direction of the printing medium.

Description of Ink Defective Discharge Detection and Scratch Detection

Figure 5A:
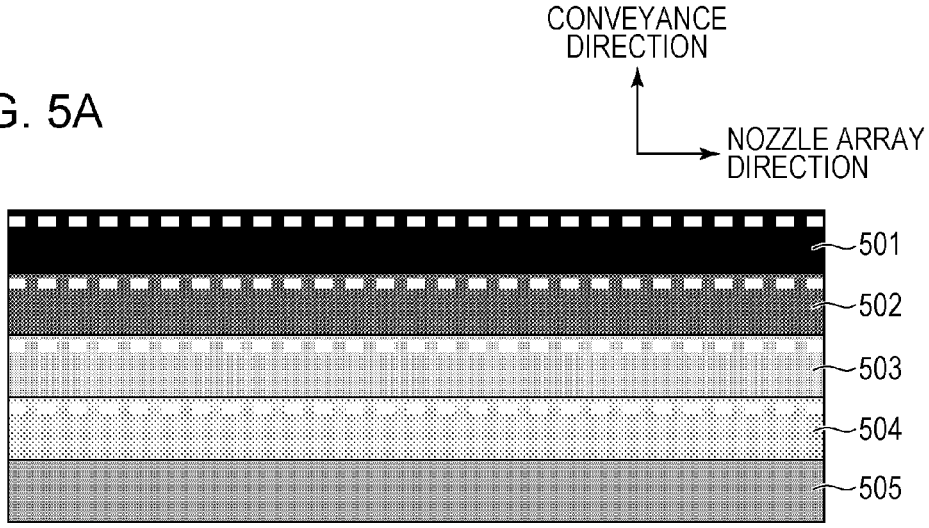
FIGS. 5A through 5C are diagrams illustrating an ink defective discharge detection pattern and scratch detection pattern.
Figure 5B:
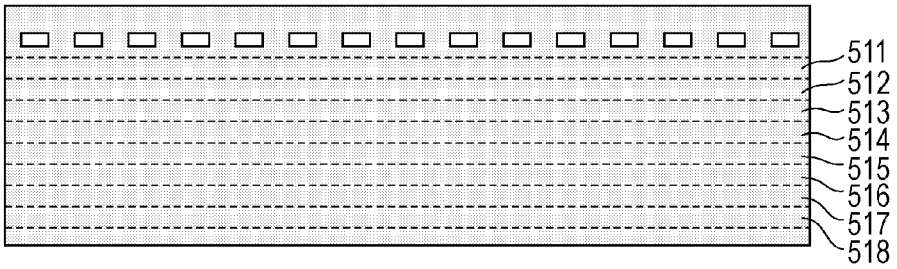
Figure 5C:
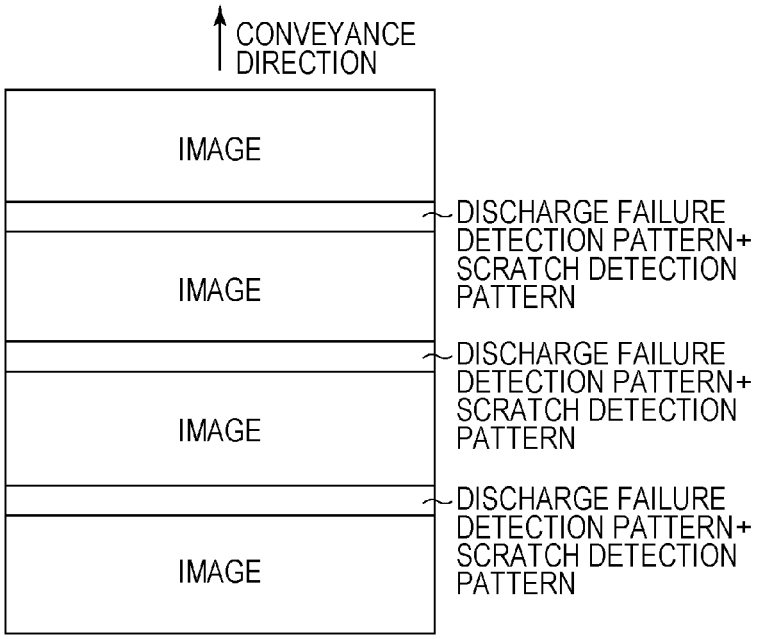

FIGS. 5A through 5C are diagrams to explain a test pattern to detect defective discharge of nozzles which are the printing elements according to the present embodiment (hereinafter referred to as "ink defective discharge detection pattern") and a test pattern to detect consecutive scratches on a printing medium (hereinafter referred to as "scratch detection pattern"). Further, hereinafter defective discharge of a nozzle will be referred to as "ink defective discharge", and detecting a nozzle with defective discharge will be referred to as "defective discharge detection".

First, FIG. 5A illustrates an ink defective discharge detection pattern and a scratch detection pattern. These are patterns with uniform density. Reference numeral 501 denotes an ink defective discharge detection pattern printed by the printing head discharging Bk ink. In the same way, reference numeral 502 denotes an ink defective discharge detection pattern printed by the printing head discharging C ink, reference numeral 503 denotes an ink defective discharge detection pattern printed by the printing head discharging M ink, and reference numeral 504 denotes an ink defective discharge detection pattern printed by the printing head discharging Y ink. Reference numeral 505 denotes a scratch detection pattern which is a color mixture pattern printed by the printing heads discharging Bk ink, C ink, M ink, and Y ink.

FIG. 5B is a diagram illustrating the patterns 501 through 505 in detail. As described earlier, the printing unit 4 has a printing head for each color ink, and each printing head has eight nozzle arrays of nozzle array A through nozzle array H. In the ink defective discharge detection patterns 501 through 504, the region 511 is a region printed using nozzle array A of the printing head, and the region 512 is a region printed using nozzle array B of the printing head. In the same way, the regions 513 through 518 are regions printed using nozzle arrays C through H of the printing head, respectively. On the other hand, in the scratch detection pattern 505, the region 511 is a region printed using the nozzle array A of the printing head discharging Bk ink, the nozzle array A of the printing head discharging C ink, the nozzle array A of the printing head discharging M ink, and the nozzle array A of the printing head discharging Y ink. In the same way, the region 512 is a region printed using the nozzle arrays B of the four printing heads, and the regions 513 through 518 also are regions printed using nozzle arrays C through H, respectively.

As illustrated in FIG. 5C, these patterns 501 through 505 are printed between images regarding which printing has been instructed by the user. The patterns 501 through 505 are read by the inspecting unit 5 disposed downstream from the printing unit 4 in the conveyance direction, and determination is made whether or not there is ink defective discharge of nozzles and whether or not there is a scratch, by the analyzing unit 17.

Figure 6:
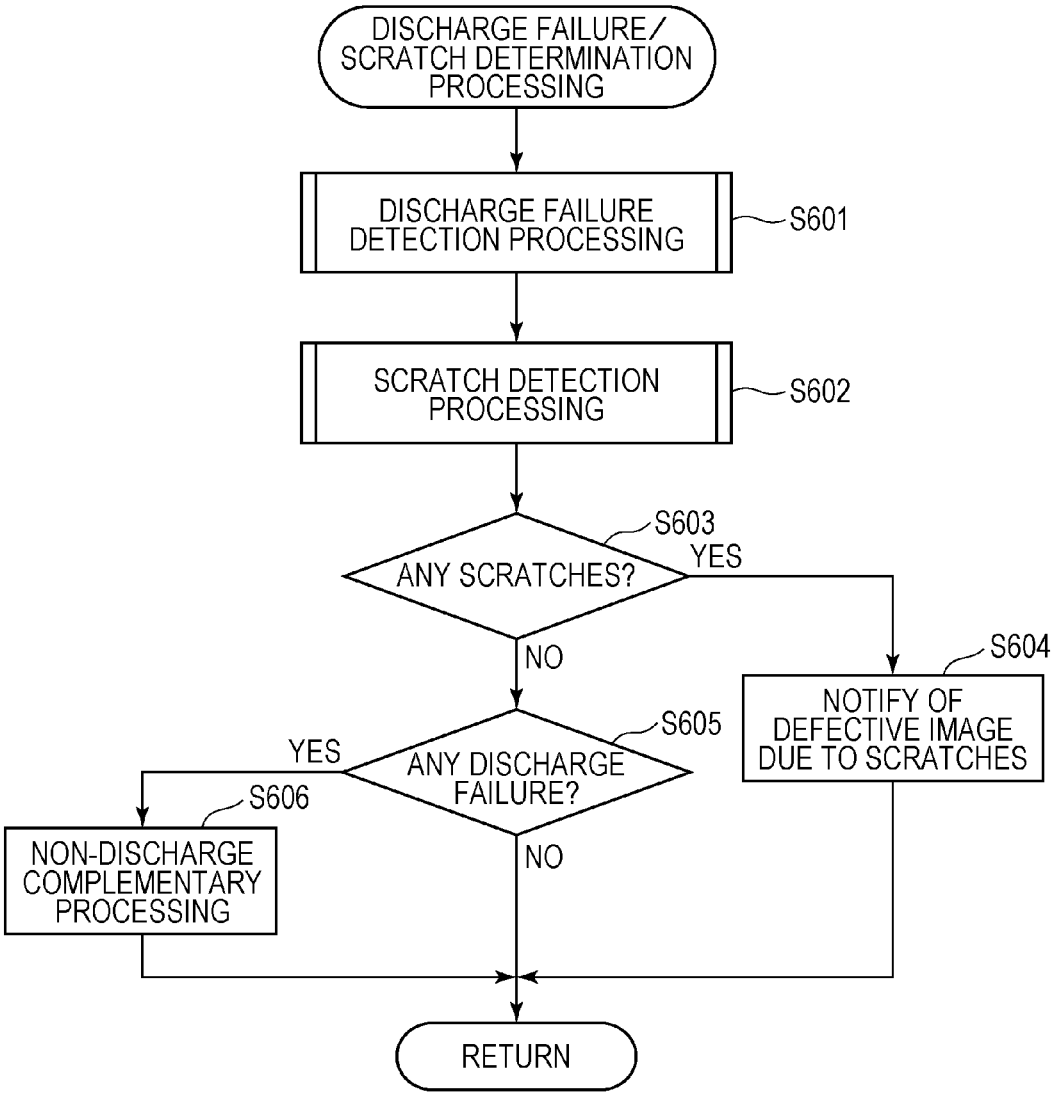
FIG. 6 is a flowchart illustrating ink defective discharge detection used in a first embodiment.

Next, the flow of determining ink defective discharge of nozzles and scratches will be described with reference to FIG. 6. First, in step S601, ink defective discharge detection is performed to detect ink defective discharge of nozzles, and in step S602 scratch detection processing is performed. The ink defective discharge detection and scratch detection processing will be described later in detail. In step S603, determination is made regarding whether or not a scratch has been detected by the scratch detection processing in step S602. That is to say, in a case where determination is made that a scratch has been detected, in other words a color difference (a white streak) is not due to ink defective discharge of a nozzle, the flow advances to step S605. On the other hand, in a case where no scratches are detected, the flow advances to step S604. If a scratch has been detected, in step S605 the user is notified using the external apparatus 16 that an image flaw has occurred due to a scratch. On the other hand, in a case where no scratches are detected, in step S604 determination is made regarding whether or not an ink defective discharge nozzle has been detected. In a case where an ink defective discharge nozzle has been detected, the flow advances to step S606, and complementation processing to print the image data, which should have been printed with the defective discharge nozzle, with a nozzle other than the detected defective discharge nozzle. If no defective discharge nozzles are detected, the flow ends.

In step S606, complementation processing is performed, in which image data assigned to be printed by the identified defective discharge nozzle is reassigned to another nozzle which is not a defective discharge nozzle. The printing apparatus according to the present embodiment has eight arrays of nozzles discharging ink of the same color, so the image data which should have been printed with the defective discharge nozzle can be reassigned to one or more of the remaining seven nozzles at the same position as the defective discharge nozzle. The method of performing complementation processing regarding a defective discharge nozzle is not restricted to this method, and known methods may be used, such as the method disclosed in Japanese Patent Laid-Open No. 2009-006560, for example.

Figure 7A:
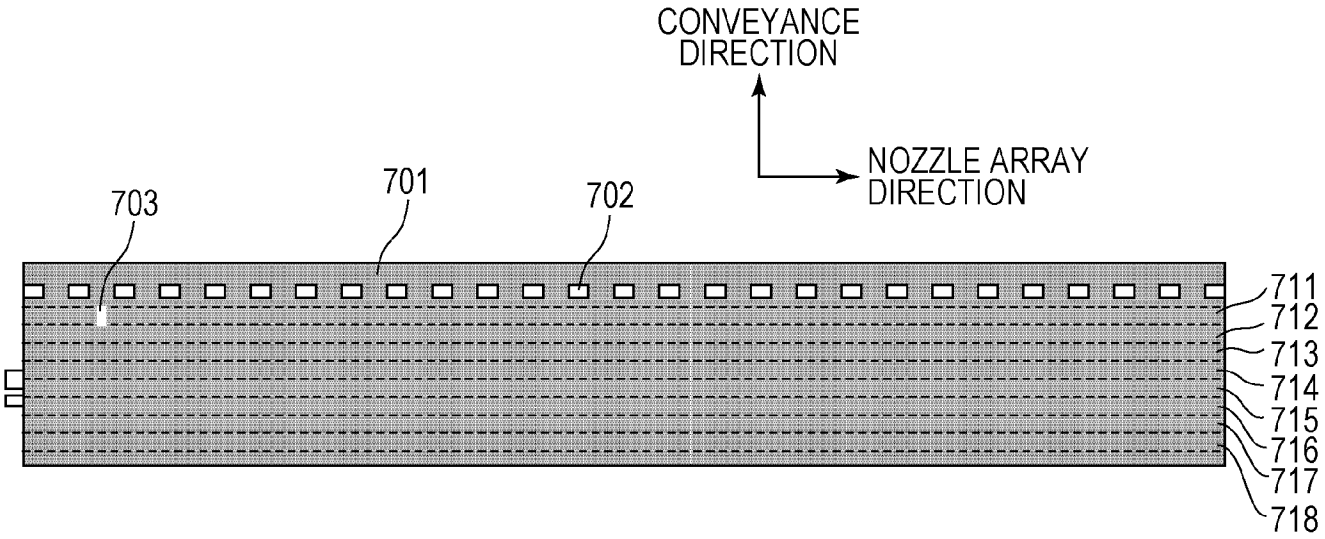
FIGS. 7A and 7B are diagrams illustrating an ink defective discharge detection pattern with a streak, and analysis results.

Next, the ink defective discharge detection processing of step S601 will be described with reference to FIGS. 7A through 8. FIG. 7A illustrates an ink defective discharge detection pattern in a case where an ink defective discharge nozzle does exist. Reference numeral 701 indicates one of ink defective discharge detection patterns 501 through 504. Detection marks 702 are marks used for detecting position, and by identifying a position where dropout has occurred in the pattern, which nozzle of the eight arrays of nozzles has not discharged can be identified. FIG. 7A illustrates a case where a part of the nozzles in the nozzle array A have failed to discharge, resulting in dropout in a part of the pattern (indicated by reference numeral 703) in the image.

Figure 7B:
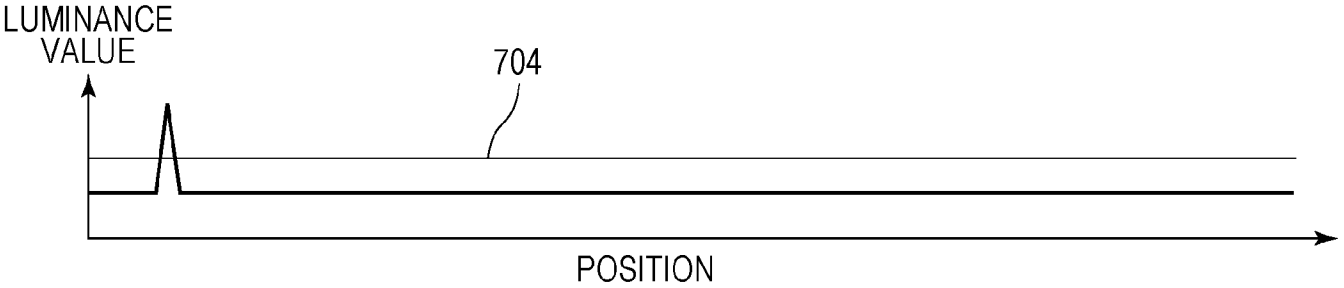
Figure 8:
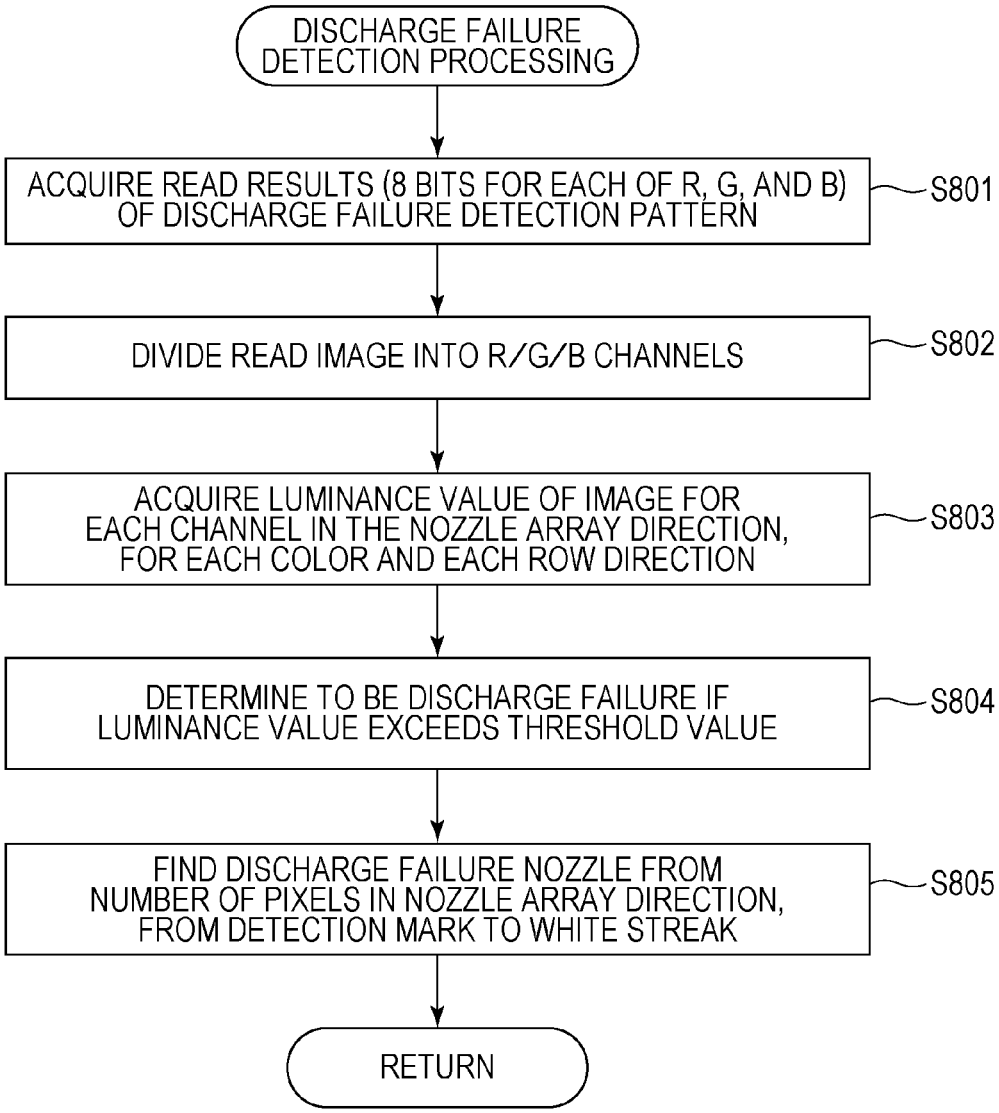
FIG. 8 is a flowchart illustrating ink defective discharge detection.

FIG. 8 is a flowchart illustrating ink defective discharge detection processing. First, in step S801 the results of having read the ink defective discharge detection patterns 501 through 504 illustrated in FIG. 5A at the inspecting unit 5 are obtained. Results of having read these using an RGB CCD sensor at 8 bits for each channel are obtained with the present embodiment. In step S802, the analyzing unit 17 divides the RGB image data that has been read into an R channel, G channel, and B channel. The Bk ink defective discharge detection pattern 501 is analyzed at the G channel, the C ink defective discharge detection pattern 502 is analyzed at the R channel, the M ink defective discharge detection pattern 503 is analyzed at the G channel, and the Y ink defective discharge detection pattern 504 is analyzed at the B channel. Next, in step S803 the luminance value for each pixel in the nozzle array direction is obtained for each image calculated at the analyzing unit 17. The luminance value obtained here is illustrated in FIG. 7B. The line 704 in FIG. 7B is a predetermined threshold value. In step S804, the luminance value corresponding to each analyzed pixel is determined. A portion where the luminance value is not within the threshold value indicated by the line 704 is determined to be a white streak. The number of pixels in the nozzle array direction (horizontal direction in FIGS. 7A and 7B) to the position of the white streak is calculated based on the positions of the detection marks, thereby identifying the position of a faulty nozzle. It would be extremely unlikely, probability-wise, that all of the nozzles in nozzle array A through nozzle array H that print the same position in the conveyance direction of the printing medium would fail at the same time. Accordingly, even if a continuous streak through all of the ink defective discharge detection patterns printed by nozzle array A through nozzle array H occurs, the probability that this is due to all of the nozzles that print the same position in the conveyance direction of the printing medium would fail at the same time is extremely low.

Figure 9A:
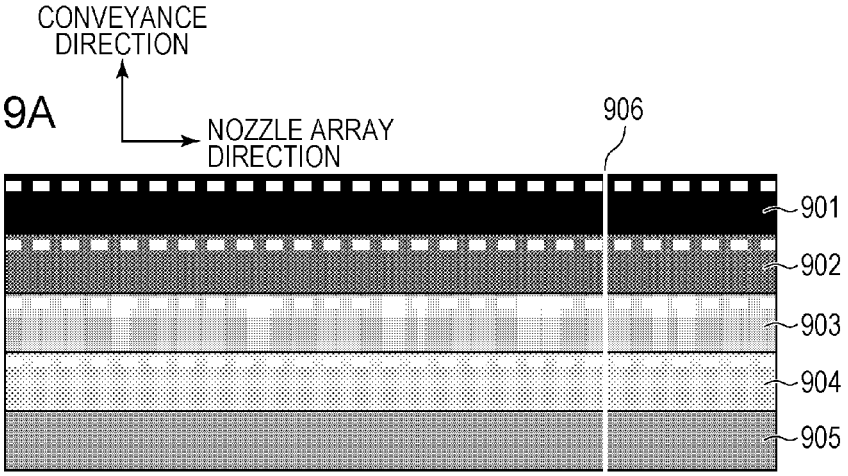
FIGS. 9A through 9F are diagrams illustrating a scratch detection method of a printing medium, used in the first embodiment.
Figure 9B:
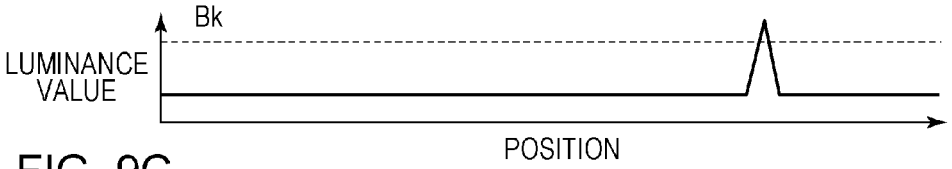
Figure 9C:
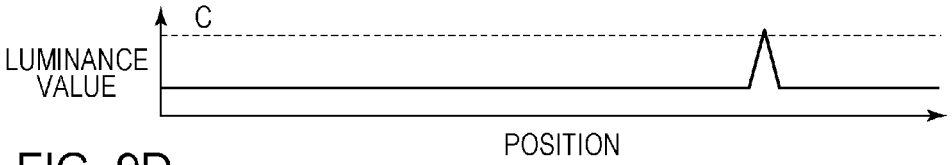
Figure 9D:
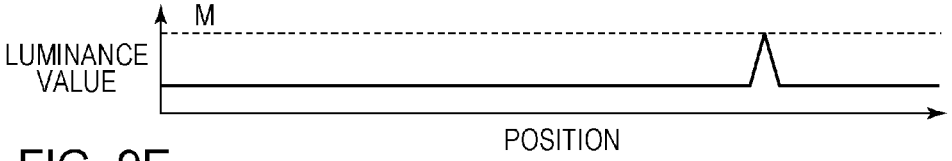
Figure 9E:
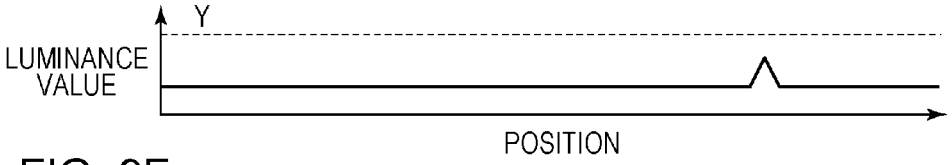
Figure 9F:
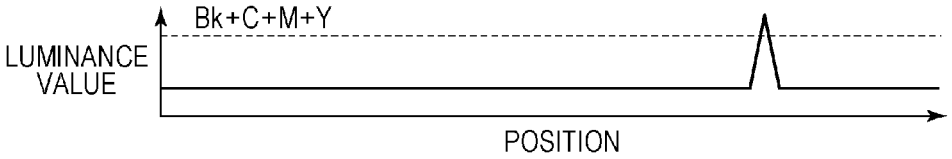
Figure 10:
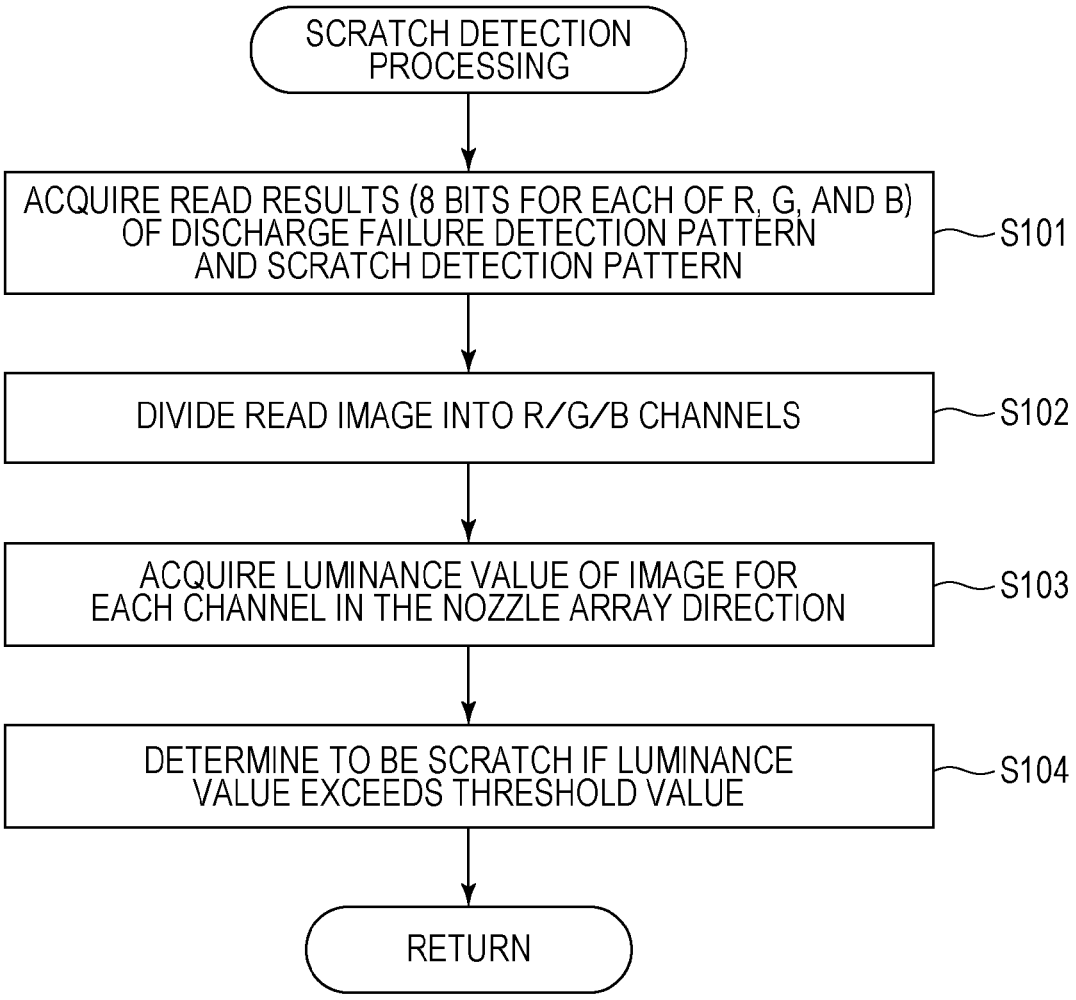
FIG. 10 is a flowchart illustrating scratch detection.

Next, the scratch detection processing in step S602 will be described with reference to FIGS. 9A through 10. FIG. 9A illustrates ink defective discharge detection patterns 901 through 904 in a case where a continuous scratch 906 has occurred on the printing medium, and a scratch detection pattern 905. FIGS. 9B through 9E illustrate luminance values obtained based on the results of reading the ink defective discharge detection pattern image printed using the nozzle array A of each printing head at the inspecting unit 5. FIG. 9F illustrates luminance values obtained based on the scratch detection pattern printed using the nozzle array A of each printing head at the inspecting unit 5. Scratches are detected by analyzing the scratch detection patterns in FIGS. 9B through 9F at the analyzing unit 17. The dotted line in the drawing represents the threshold value for determining luminance value. The scratch 906 has occurred continuously on the printing medium in the conveyance direction, and the results are the same for all of nozzle array A through nozzle array H for all colors, so description of the results of other nozzle arrays will be omitted here.

Next, details of the scratch detection processing will be described with reference to the flowchart in FIG. 10. First, in step S101, the results of having read the ink defective discharge detection patterns 901 through 904 and scratch detection pattern 905 by the inspecting unit 5 are obtained. Results of having read these using an RGB CCD sensor at 8 bits for each channel are obtained with the present embodiment. In step S102, the analyzing unit 17 performs analysis in the same way as with step S802 in FIG. 8, and in step S103, the analyzing unit 17 obtains the luminance value for each pixel in the nozzle array corresponding to each nozzle array. In step S104, whether or not the luminance value corresponding to each analyzed pixel is not within a threshold value is determined for each pattern. In a case where there is a streak in the scratch detection pattern 905 where the obtained luminance values are greater than the threshold, determination is made that a consecutive scratch exists on the printing medium, i.e., the streak is not due to a faulty nozzle. On the other hand, in a case where there is a streak at a corresponding position in one of the ink defective discharge detection patterns 901 through 904 but there is no streak in the scratch detection pattern 905, determination is made that a nozzle corresponding to that position is faulty, and the streak has been caused by a faulty nozzle.

Note that the scratch detection pattern 905 according to the present embodiment is an image formed using four ink colors, by eight arrays of nozzles for each color. It would be extremely unlikely, probability-wise, that all of the nozzle arrays of all of the ink colors would fail to discharge at the same location. Accordingly, regardless of the results of the ink defective discharge detection patterns 901 through 904, a case where the luminance value of the scratch detection pattern 905 is greater than the threshold value can be determined to be a streak due to a scratch and not due to faulty nozzles.

In a case where a nozzle has been determined to be faulty, complementation processing is performed to print the image data which should have been printed with the defective discharge nozzle with a nozzle other than the faulty nozzle. Conventional methods may be used for complementation processing. For example, the data may be reassigned to a nozzle adjacent to the faulty nozzle, or assigned to another normal nozzle in another of multiple scans.

Using the above method enables determination to be suitably made regarding whether or not a streak in a printed image is a streak due to printing failure by a printing element.

While the scratch detection pattern according to the present embodiment has been printed using eight arrays of nozzles for each of the four ink colors, the present invention is not restricted to this arrangement. As long as the printing head has at least multiple nozzle arrays, and is capable of printing at the same position on the printing medium in the nozzle array direction, a scratch detection pattern can be printed using multiple nozzles. That is to say, a scratch detection pattern is printed using at least two nozzle arrays capable of printing at the same position on the printing medium, and in a case where the luminesce value is determined to be greater than the threshold value, determination is made that this is a scratch on the printing medium. In the event that the luminance value is not greater than the threshold value, determination is made regarding whether or not a faulty nozzle is included in the nozzles which have printed the scratch detection pattern. This scratch detection pattern does not have to be a pattern formed of inks of multiple colors. A pattern may be printed by at least two nozzle arrays of at least one color printing head, and in a case where a streak is detected where the luminance value at a position printed by two nozzle arrays is greater than the threshold value, this can be determined to be a scratch and not defective discharge.

The greater the number of nozzles printing the scratch detection pattern is, the less likely to be influenced by faulty nozzles, so the accuracy in determining whether a faulty printing element or a scratch on the printing medium improves. That is to say, in the example described above, eight nozzle arrays for each of four color inks, which is a total of 32 nozzles, are used to printing the scratch detection pattern. For example, in a case of determining a scratch from a pattern printed by one color ink using the printing apparatus according to the present embodiment, the accuracy of scratch determination can be improved by printing the pattern using eight nozzle arrays.

Also, while description has been made above regarding the present embodiment that in a case where determination is made in step S603 that there is a scratch, the flow advances to step S605, the user is notified, and the flow ends, but an arrangement may be made where in a case that both a scratch and faulty nozzle are detected, the user may be notified and defective discharge complementation printing is also performed. That is to say, after the user is notified in step S605, the flow advances to step S604, determination is made whether or not there is a faulty nozzle at a position other than where the scratch has occurred, and if there is a faulty nozzle, defective discharge complementation processing is performed in step S606. If no faulty nozzles exist, the flow ends. Thus, scratches can be detected and defective discharge complementary processing can be performed in a case where both are present.

Second Embodiment

The basic configuration of the primary mechanism of the ink-jet printing apparatus according to a second embodiment, and the control configuration for executing printing control at each part of the printing apparatus, is the same as with the first embodiment. In the first embodiment, determination is made that a white streak is due to a scratch in a case where a streak is detected in an inspection pattern formed using multiple nozzles. In the present embodiment, determination is made that a white streak is due to a scratch and not due to defective discharge in a case where defective discharge is detected in ink defective discharge detection processing performed on an inspection pattern formed with one nozzle, and defective discharge is detected again after having performed ink defective discharge complementation processing.

Figure 11:
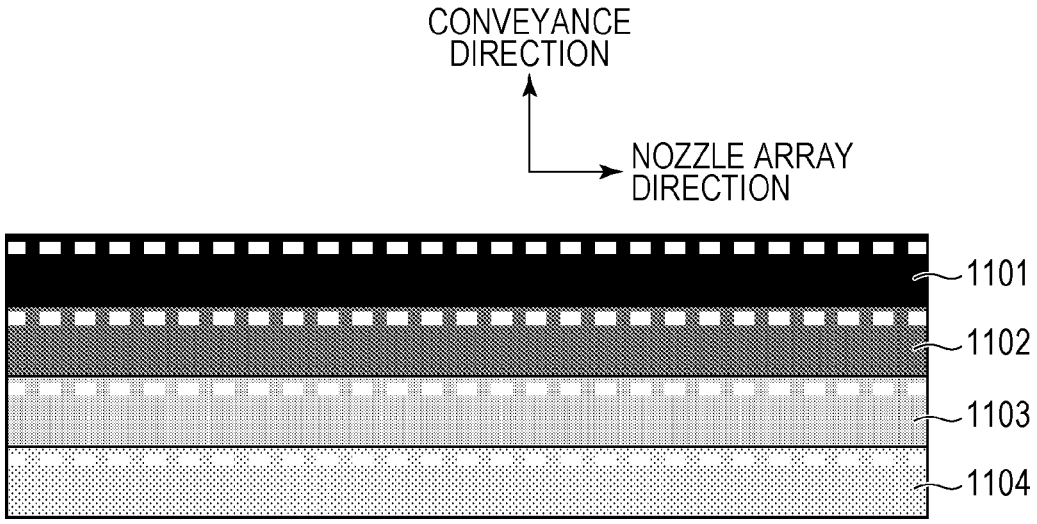
FIG. 11 is a diagram illustrating an ink defective discharge detection pattern according to a second embodiment.

FIG. 11 is an ink defective discharge detection pattern according to the present embodiment. The ink defective discharge detection pattern is configured including a pattern 1101 printed with Bk ink, a pattern 1102 printed with C ink, a pattern 1103 printed with M ink, and a pattern 1104 printed with Y ink. Each pattern is a solid pattern with a printing rate of 100%, printed by discharging ink multiple times consecutively, by one array each of the eight nozzle arrays of each head, sequentially. The ink defective discharge detection pattern according to the present embodiment is printed between images and read, as illustrated in FIG. 5C.

Figure 12:
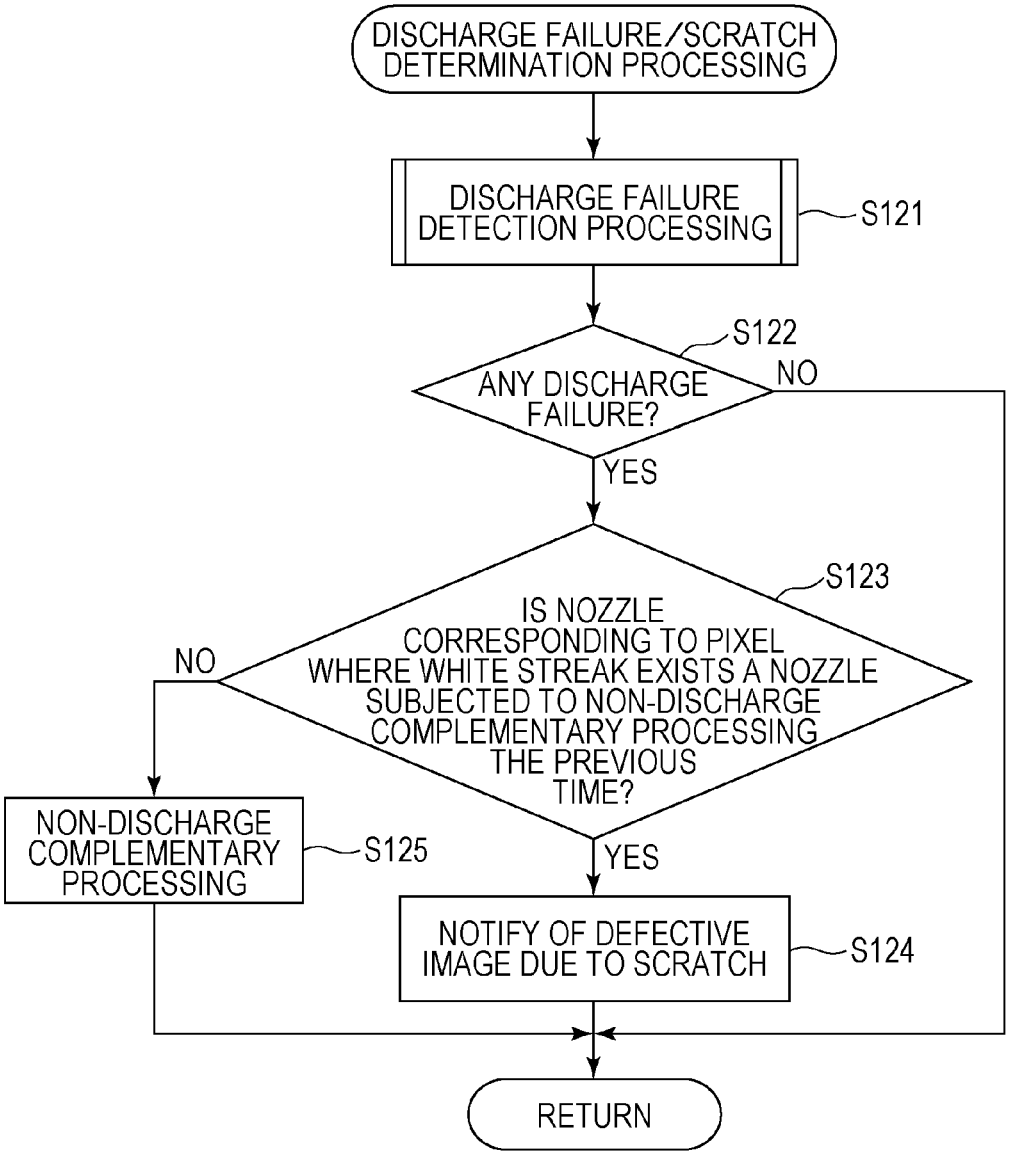
FIG. 12 is a flowchart illustrating ink defective discharge detection used in the second embodiment.

FIG. 12 is a flowchart for performing ink defective discharge determination according to the present embodiment. The ink defective discharge detection processing in step S121 is the same as that in FIG. 8 according to the first embodiment. In step S122, determination is made regarding whether or not there is a white streak in the inspection pattern. In a case where there is a white streak, determination is made in step S123 by the analyzing unit 17 regarding whether or not the streak is at a pixel which corresponds to a nozzle regarding which ink defective discharge complementation processing was performed the previous time. In a case where determination is made in step S123 that the streak is at a pixel which corresponds to a nozzle regarding which ink defective discharge complementation processing was performed the previous time, the white streak was not suppressed by the ink defective discharge complementation processing, so determination is made that the white streak is not due to a faulty nozzle but due to a scratch. In step S124, the user is notified through the external apparatus 16 that the image is defective due to a scratch. On the other hand, in a case where determination is made in step S123 that the streak is at a pixel that is not a pixel which corresponds to a nozzle regarding which ink defective discharge complementation processing was performed the previous time, determination is made that defective discharge of a nozzle has occurred anew, and ink defective discharge complementation processing is performed for that nozzle in step S125. Thus, whether a white streak is due to defective discharge or a scratch can be determined by performing ink defective discharge detection processing multiple times using inspection patterns printed using one time.

While the present embodiment has been described where determination is made of whether or not the nozzle corresponding to the streak position is a nozzle regarding which ink defective discharge complementation processing was performed the previous time, an arrangement may be made regarding whether or not there is history of ink defective discharge complementation processing.

Third Embodiment

Figure 13:
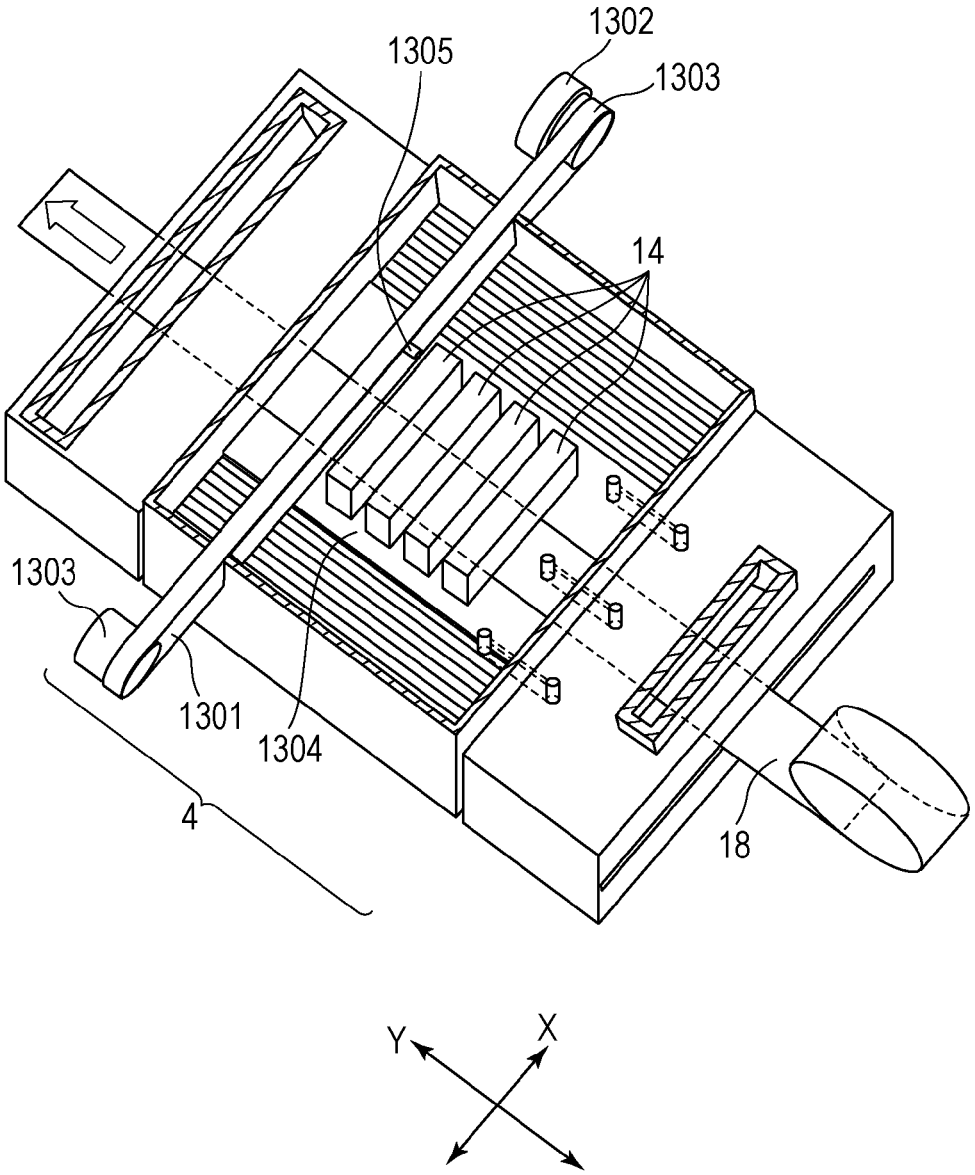
FIG. 13 is a diagram illustrating a printing unit used in a third embodiment.

The basic configuration of the primary mechanism of the ink-jet printing apparatus according to a third embodiment, and the control configuration for executing printing control at each part of the printing apparatus, is the same as with the first embodiment. The present embodiment also has a mechanism where the printing head 14 is movable in the array direction of nozzles as illustrated in FIG. 13. Movement of the printing head and white streak detection processing are combined such that, in a case where a white streak occurs at the same position on the printing medium even though printing has been performed with the printing head moving, determination is made that the white streak is due to a scratch on the printing medium.

FIG. 13 is a perspective view of the configuration of the printing unit 4 of the printing apparatus so as to print images. Ink is discharged from printing heads 14 onto a sheet 18 conveyed in the Y direction. The printing unit 4 includes a displacement mechanism made up of a belt 1301, a pulse motor 1302, a pulley 1303, and a holder 1304 which can move the printing heads 14 in the array direction of the nozzles (X direction in FIG. 13). The holder 1304 is fixed to the belt 1301 by an attachment member 1305. The pulley 1303 attached to the belt 1301 is driven by the pulse motor 1302. The control unit 13 includes a printing sheet width detecting unit and printing head movement control unit, determines a usage region of the printing heads 14 based on printing sheet width information, and drives the pulse motor 1302 using the printing head movement control unit to move the printing heads 14. This control enables the nozzles being used to print the same pixel on the sheet 18 to be changed. The printing width of the printing heads 14 is 13 inches, so the printing heads 14 can be moved to print using different nozzles, for sheets as large as A3 size.

Figure 14:
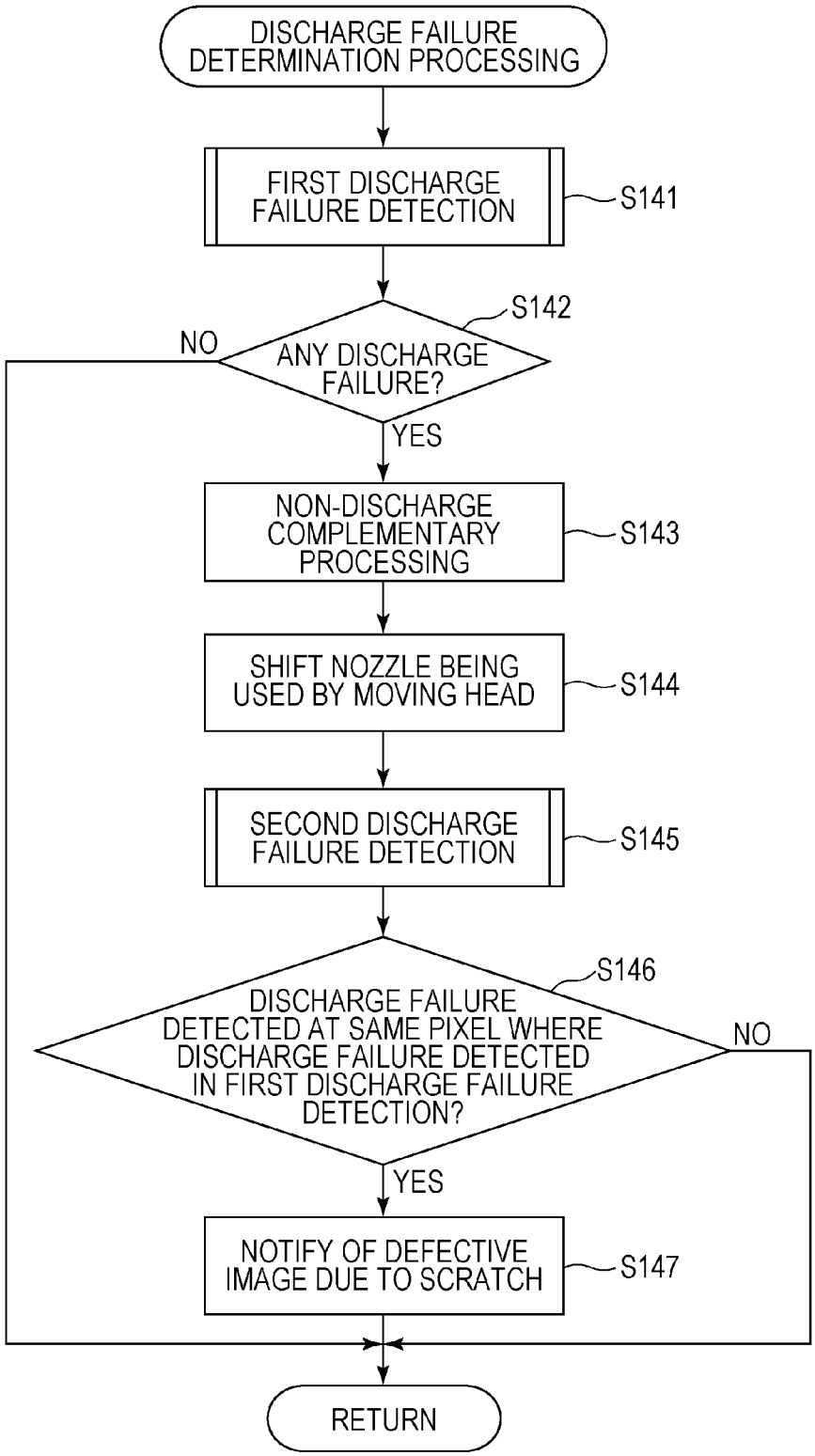
FIG. 14 is a flowchart illustrating ink defective discharge detection used in the third embodiment.

FIG. 14 illustrates a flowchart for ink defective discharge detection processing according to the present embodiment. In first ink defective discharge detection processing in step S141, ink defective discharge detection processing is performed a first time (first printing step and first reading step). In step S142, determination is made regarding whether or not there is a streak in the inspection pattern (first determination step). In a case where there is a white streak, ink defective discharge complementation processing is performed in step S143, and in step S144 the printing heads 14 are moved in the array direction of the nozzles so as to shift the nozzles being used. After moving the printing heads 14, ink defective discharge detection processing is performed again in step S145, as second ink defective discharge detection processing (second printing step and second reading step), and determination is made regarding whether or not there is a streak. In step S146, determination is made regarding whether a white streak has been detected for the same pixel as the pixel regarding which the streak was detected in the first ink defective discharge detection processing (second determination step). In a case where the result of step S146 is Yes, this means that the white streak is not due to a faulty nozzle but due to a scratch on the sheet, so the user is notified in step S147 through the external apparatus 16 that the image is defective due to a scratch. Thus, determination can be made regarding whether a white streak is due to defective discharge or a scratch on a printing medium by moving the printing heads between ink defective discharge detection processing, and changing the nozzles used for the ink defective discharge detection processing.

Fourth Embodiment

A fourth embodiment relates to another example where scratch determination is made from ink defective discharge detection patterns without using a scratch detection pattern. The basic configuration of the primary mechanism of the ink-jet printing apparatus according to the present embodiment, and the control configuration for executing printing control at each part of the printing apparatus, is the same as with those described above. The present embodiment uses the same ink defective discharge detection pattern as that used in the second embodiment (FIG. 11). Details of the ink defective discharge detection patterns for each color are the same as illustrated in FIG. 7A.

Figure 15:
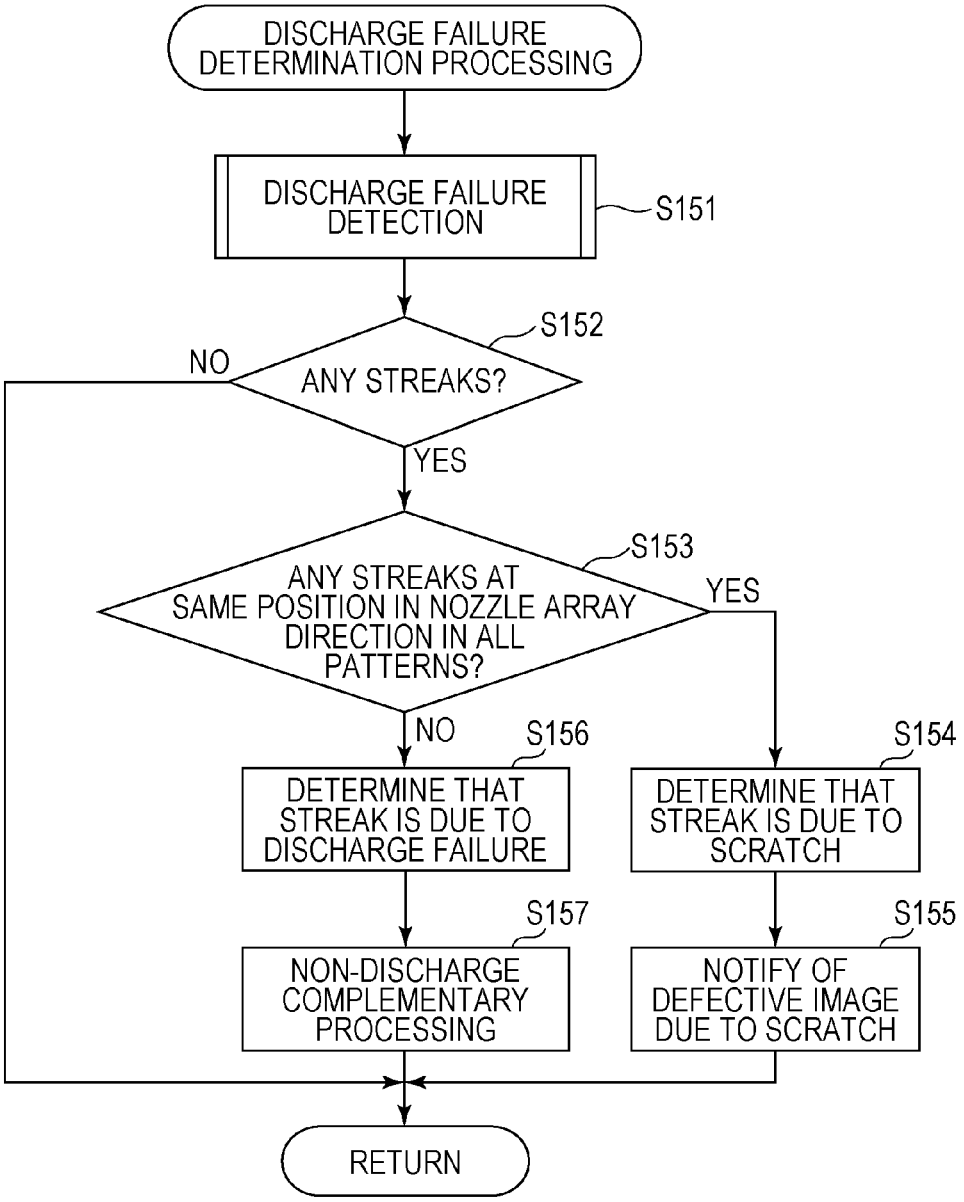
FIG. 15 is a flowchart illustrating ink defective discharge detection used in a fourth embodiment.

FIG. 15 is a flowchart illustrating a faulty nozzle and scratch determination processing flow according to the present embodiment. In step 151, ink defective discharge detection processing to detect an ink defective discharge nozzle is executed. The ink defective discharge detection processing is the same as the processing in step S601 according to the first embodiment. In step S152, determination is made regarding whether or not there is a streak in the pattern that has been read. In a case where determination is made in step S152 that there is no streak, the flow ends. In a case where determination is made in step S152 that there is a streak, the flow advances to step S153, where determination is made whether the streak is in the conveyance direction of the printing medium at the same position in the direction of array of the nozzles, in all of the patterns. The present embodiment is arranged with eight arrays of nozzles for each ink color, and one pattern is printed for each array, in the same way as with the above-described embodiments. Accordingly, determination is made regarding whether there is a streak following the conveyance direction of the printing medium, at the same position in the direction of array of the nozzles, in all 32 patterns. In a case where determination is made that there is a streak in all patterns, the flow advances to step S154. Determination is then made that the streak in the patterns is due to a scratch on the printing medium, and not due to defective discharge of the nozzles which have printed this position. On the other hand, in a case where determination is made that there is not a streak at the same position in the direction of array of the nozzles in all patterns, the flow advances to step S156. Note that the determination in step S155 is made that if there is even one pattern of all the patterns having a streak, and even one pattern not having a streak at the position as this streak in the nozzle array direction, the determination result is No. That is to say, No is returned as a result if there is even one pattern without a streak, even if there are streaks in the remaining 31 patterns of the 32 patterns. Determination is then made in step S156 that the streak that has occurred is due to defective discharge of a nozzle, and that the nozzle which has printed this position is faulty.

In a case where determination is made in step S154 that the streak is due to a scratch on the printing medium, the flow advances to step S155, and the user is notified through the external apparatus 16 that the image is defective due to a scratch. On the other hand, in a case where determination is made in step S156 that the streak is due to defective discharge of a nozzle, the flow advances to step S157. In step S157, complementation processing is performed, in which image data assigned to be printed by the identified defective discharge nozzle is reassigned to another nozzle which is not a defective discharge nozzle, and the processing ends.

Using this method enables suitable determination regarding whether or not a streak occurring in a printed image is a streak due to printing failure of a printing element or otherwise, without using a scratch detection pattern.

An arrangement may also be made in the same way as with the first embodiment, where after performing notification of a scratch in step S155, the flow advances to step S157 and ink defective discharge complementation processing is performed for streaks at positions other than where the scratch was detected.

Note that in the present embodiment, ink defective discharge detection patterns are formed by eight nozzle arrays of each color, the patterns of the 32 arrays are read, and in a case where there is a streak in all patterns, determination is made that the streak is not due to printing failure but due to a scratch on the printing medium. However, the present invention is not restricted to this arrangement.

For example, an ink defective discharge detection pattern may be formed by one array each of the four colors, a total of four patterns. Also, while determination is made that the streak is not due to printing failure by a nozzle but due to a scratch on the printing medium when there is a streak at the same position in the nozzle array direction in all 32 patterns, but all patterns do not have to be examined, to alleviate the processing load. An arrangement may be made where a predetermined plurality of patterns are examined, and if there is a streak in the same position in the nozzle array direction, determination is made that the streak is not due to defective discharge of a nozzle. Also, an arrangement may be made where one of the eight ink defective discharge detection patterns corresponding to the eight arrays of nozzles for each color is examined for each color, for a total of four patterns, and if a streak is present in all of these four patterns, determination is made that the streak is due to a scratch on the printing medium, and not due to defective discharge of a nozzle. Moreover, this does not have to be one pattern from each color by may be multiple patterns from each color, and further, different nozzle arrays may be selected each time the detection flow is executed.

Also, while description has been made above that determination is made that the streak is due to defective discharge of a nozzle and not to a scratch on the printing medium, if there is no streak at the same position in any one pattern of the 32 patterns, but an arrangement may be made wherein determination is made that the streak is due to a scratch on the printing medium in a case where there is a streak in not all patterns but a predetermined plurality of patterns. This is because there are cases where determination of streaks may be difficult depending on the lightness of the ink used to printing the pattern. For example, a pattern printed with a light color material has a high luminance value, so the difference as to the luminance value of a scratch is small, the streak may be visually difficult to recognize, and may not be determined to be a streak. On the other hand, a pattern printed with a less light color material has a low luminance value, so the difference as to the luminance value of a scratch is great, the streak is visually recognizable, and is readily determined to be a streak.

Figure 16A:
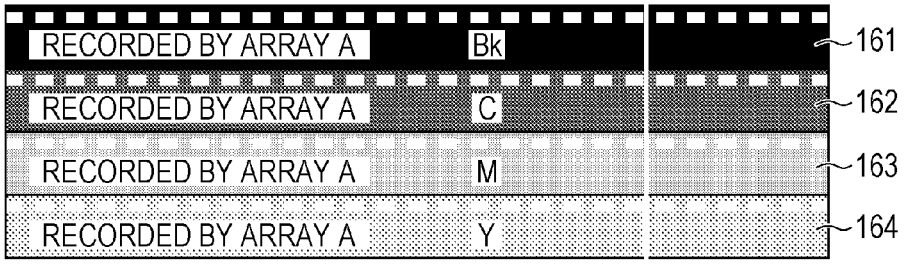
FIGS. 16A through 16E are diagrams illustrating an ink defective discharge detection pattern with a streak, and analysis results.
Figure 16B:
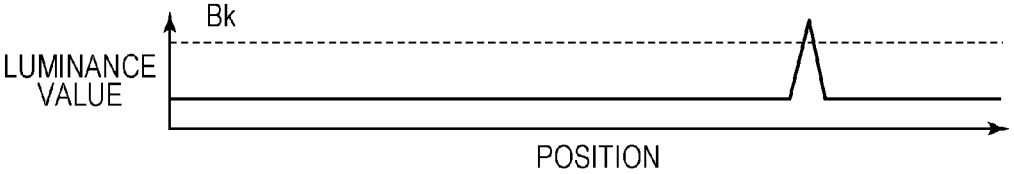
Figure 16C:
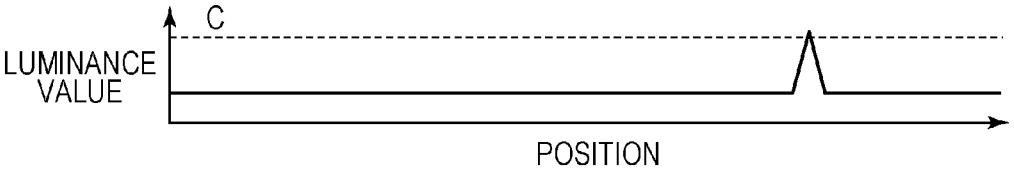
Figure 16D:
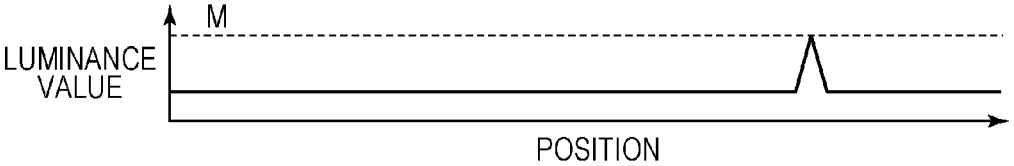
Figure 16E:
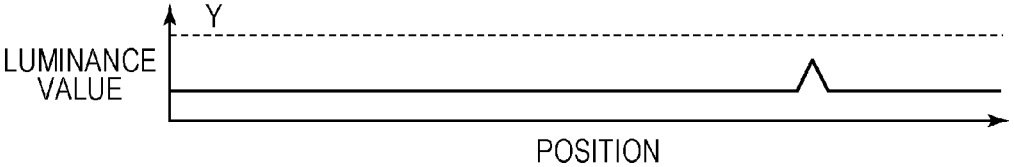

FIGS. 16A through 16E are diagrams illustrating ink defective discharge detection patterns of four colors, and luminance values measured for the patterns. FIG. 16A illustrates the ink defective discharge detection patterns, showing that the white streak is less conspicuous in the magenta pattern and yellow pattern. The luminance value of the black ink defective discharge detection pattern illustrated in FIG. 16B and luminance value of the cyan ink defective discharge detection pattern illustrated in FIG. 16C are above the threshold value indicated by the dotted line, so determination can be made that there is a streak in the image. On the other hand, the luminance value of the magenta ink defective discharge detection pattern illustrated in FIG. 16D and the luminance value of the yellow ink defective discharge detection pattern illustrated in FIG. 16E are not above the threshold value indicated by the dotted line, so determination is not made that there is a streak in the image. Accordingly, an arrangement may be made where the streak is determined to be due to a paper scratch in a case where the luminesce values of at least two predetermined ink defective discharge detection patterns (Bk and C ink defective discharge detection patterns in the present embodiment) exceed the threshold value at the corresponding position. Alternatively, an arrangement may be made where determination is performed for the eight patterns of a predetermined one color, such as Bk or C, and determination is made that the streak is due to a scratch on the printing medium in a case where a white streak is present at the same position in all patterns. This enables the processing load to be alleviated while obtaining a suitable determination accuracy, as compared to a case of determining the streak to be due to a scratch on the printing medium in a case where the streak is present in all test patterns.

Other Embodiments

While an example of printing ink defective discharge detection patterns and scratch detection patterns on a printing medium, the present invention is not restricted to this. For example, in a case of the printing medium being adhered to a conveying arrangement such as a conveyance belt and conveyed, the ink defective discharge detection pattern or scratch detection pattern may be printed on the conveying arrangement and measured.

Also, while description has been made in the above embodiments that determination is made that the streak is due to a scratch in a case where the luminance value of read patterns exceeds a threshold value, the determination results are not restricted to this. For example, determination may be made of trouble other than printing failure of a printing element, such as a streak on an image due to a scanner abnormality, and notified to the user. Also, the present invention is not restricted to notifying a user to this effect, and may be arranged to automatically stop or shut down the apparatus.

Also, the present invention is not restricted to an arrangement where the presence or absence of streaks is determined from the luminance value of read patterns. Any method may be applied so long as it is a method whereby presence of a streak can be determined in a case that there is an abnormality in a read pattern. For example, the colorimetric value of the pattern may be measured, the measured colorimetric value such as RGB value or Lab value compared with a prepared target value, and determination made that there is a streak in the pattern in a case where the color difference exceeds a threshold value.

Also, the present invention is not restricted to a case of detecting an abnormality occurring in a pattern which is a streak with high luminance value or lightness. For example, the present invention also includes detecting an abnormality occurring in a pattern which is a streak with low luminance value or lightness (black streak). In this case, determination of an abnormality may be made in a case where the luminance value or lightness value is smaller than a threshold value stored beforehand, or determination may be made that there is a streak in a case where the color difference exceeds a threshold value stored beforehand.

Also, while description has been made in the above embodiments regarding an example of defective discharge of nozzles which are ink-jet printing elements, the printing elements are not restricted to the ink-jet method, and may be any sort of printing element as long as printing/non-printing control can be made for each pixel. Also, ink complementation processing performed on printing elements which fail to print may be according to any sort of method, as long as a printing element other than the faulty printing element is used to perform the complementation processing. Moreover, the ink-jet method may use any of heating elements, piezoelectric elements, electrostatic elements, microelectromechanical system (MEMS) elements, or the like.

The above-described configuration enables distinguishing between streaks due to faulty printing elements printing images on a printing medium and streaks due to trouble other than faulty printing elements, by using test patterns printed by different printing elements at the same position on the printing medium in the conveyance direction. Accordingly, erroneous determination of faulty printing elements can be reduced, and high-quality images can be obtained without performing unnecessary complementation processing.

Other Embodiments

Additional embodiments can also be realized by a computer of a system or apparatus that reads out and executes computer executable instructions recorded on a storage medium (e.g., computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and function.

This application claims the benefit of Japanese Patent Application No. 2013-107471 filed May 21, 2013, and Japanese Patent Application No. 2014-075827 filed Apr. 1, 2014, which are hereby incorporated by reference herein in their entirety.

What is claimed is:

1. An image processing method for printing an image on a printing medium transported in a second direction, using a printing head on which a first printing element array and a second printing element array, each including a plurality of printing elements arrayed in a first direction which crosses to the second direction, are arrayed in the second direction, the method comprising:

an obtaining step to obtain information regarding a position where color difference in the first direction has occurred in each of a first test pattern printed using the first printing element array and not using the second printing element array, and a second test pattern printed using both the first printing element array and second printing element array, the test patterns having been printed on the printing medium or on a conveyance unit which transports the printing medium; and a determining step to determine a printing element in the first printing element array corresponding to a position where color difference has occurred to not have failed in printing, in a case where the obtained information indicates that color difference has occurred in the second test pattern, and to determine a printing element in the first printing element array corresponding to a position where color difference has occurred to have failed in printing, in a case where the obtained information indicates that color difference has not occurred in the second test pattern at a same position in the first direction as a position where the color difference has occurred in the first test pattern.

2. The image processing method according to claim 1, wherein a user is notified of results of the determination made in the determining step.

3. The image processing method according to claim 1, wherein the predetermined test patterns are all of the plurality of test patterns.

4. The image processing method according to claim 1, wherein the plurality of printing element arrays includes a printing element array corresponding to a first color material, and a printing element array corresponding to a second color material of which a lightness is lower than that of the first color material;

and wherein the predetermined test patterns do not include test patterns printed by the first color material but include test patterns printed by the second color material.

5. The image processing method according to claim 4, wherein the first color material is a black or cyan color material, and the second color material is a magenta or yellow color material.

6. The image processing method according to claim 1, wherein the information obtained in the obtaining step indicates a position where a luminance value exceeds a predetermined threshold value.

7. The image processing method according to claim 1, wherein the information obtained in the obtaining step indicates a position where color difference, compared to a target value stored in advance, exceeds a predetermined threshold value.

8. The image processing method according to claim 1, wherein the printing elements are ink jet printing elements which discharge ink.

9. The image processing method according to claim 1, wherein the plurality of test patterns are test patterns with uniform density.

10. An image processing apparatus comprising:

a printing head on which a first printing element array and a second printing element array, each including a plurality of printing elements arrayed in a first direction which crosses a second direction, are arrayed in the second direction, to print an image on a printing medium transported in the second direction;

an obtaining unit configured to obtain information regarding a position where color difference in the first direction has occurred in each of a first test pattern printed using the first printing element array and not using the second printing element array, and a second test pattern printed using both the first printing element array and second printing element array, the test patterns having been printed on the printing medium or on a conveyance unit which transports the printing medium; and a determining unit configured to determine a printing element in the first printing element array corresponding to a position where color difference has occurred to not have failed in printing, in a case where the obtained information indicates that color difference has occurred in the second test pattern, and to determine a printing element in the first printing element array corresponding to a position where color difference has occurred to have failed in printing, in a case where the obtained information indicates that color difference has not occurred in the second test pattern at a same position in the first direction as a position where the color difference has occurred in the first test pattern.

11. A non-transitory computer-readable storage medium storing a program which controls a computer, for printing image on a printing medium transported in a second direction by using a printing head on which a first printing element array and a second printing element array, each including a plurality of printing elements arrayed in a first direction which crosses to the second direction, are arrayed in the second direction, to execute:

an obtaining step to obtain information regarding a position where color difference in the first direction has occurred in each of a first test pattern printed using the first printing element array and not using the second printing element array, and a second test pattern printed using both the first printing element array and second printing element array, the test patterns having been printed on the printing medium or on a conveyance unit which transports the printing medium; and a determining step to determine a printing element in the first printing element array corresponding to a position where color difference has occurred to not have failed in printing, in a case where the obtained information indicates that color difference has occurred in the second test pattern, and to determine a printing element in the first printing element array corresponding to a position where color difference has occurred to have failed in printing, in a case where the obtained information indicates that color difference has not occurred in the second test pattern at a same position in the first direction as a position where the color difference has occurred in the first test pattern.

12. An image processing method for printing an image on a printing medium transported in a second direction, using a printing head on which a first printing element array and a second printing element array, each including a plurality of printing elements arrayed in a first direction which crosses to the second direction, are arrayed in the second direction, the method comprising:

an obtaining step to obtain information regarding a position where color difference in the first direction has occurred in each of a first test pattern printed using the first printing element array and not using the second printing element array, and a second test pattern printed using the second printing element array, the test patterns having been printed on the printing medium or on a conveyance unit which transports the printing medium; and a determining step to determine a printing element in the first printing element array corresponding to a position where color difference has occurred to not have failed in printing, in a case where the obtained information indicates that color difference has occurred in the second test pattern, and to determine a printing element in the first printing element array corresponding to a position where color difference has occurred to have failed in printing, in a case where the obtained information indicates that color difference has not occurred in the second test pattern at a same position in the first direction as a position where the color difference has occurred in the first test pattern.

13. The image processing method according to claim 12, wherein the second test pattern is printing by not using the first printing element array.

* * * * *